US010808702B2

(12) United States Patent
Coeckelbergs

(10) Patent No.: US 10,808,702 B2
(45) Date of Patent: Oct. 20, 2020

(54) METHOD FOR CONTROLLING A GAS SUPPLY TO A VACUUM PUMP

(71) Applicant: ATLAS COPCO AIRPOWER, NAAMLOZE VENNOOTSCHAP, Wilrijk (BE)

(72) Inventor: Joeri Coeckelbergs, Wilrijk (BE)

(73) Assignee: ATLAS COPCO AIRPOWER, NAAMLOZE VENNOOTSCHAP, Wilrijk (BE)

( * ) Notice: Subject to any disclaimer, the term of this patent is extended or adjusted under 35 U.S.C. 154(b) by 444 days.

(21) Appl. No.: 15/542,726

(22) PCT Filed: Jan. 7, 2016

(86) PCT No.: PCT/BE2016/000005
§ 371 (c)(1),
(2) Date: Jul. 11, 2017

(87) PCT Pub. No.: WO2016/112442
PCT Pub. Date: Jul. 21, 2016

(65) Prior Publication Data

US 2017/0350397 A1 Dec. 7, 2017

Related U.S. Application Data

(60) Provisional application No. 62/103,723, filed on Jan. 15, 2015, provisional application No. 62/103,766, filed on Jan. 15, 2015.

(30) Foreign Application Priority Data

Feb. 11, 2015 (BE) ..... 2015/5072
Feb. 11, 2015 (BE) ..... 2015/5074

(51) Int. Cl.
*F04C 29/00* (2006.01)
*F04C 28/24* (2006.01)
(Continued)

(52) U.S. Cl.
CPC ..... *F04C 29/0092* (2013.01); *F04C 25/02* (2013.01); *F04C 28/08* (2013.01);
(Continued)

(58) Field of Classification Search
CPC ..... F04C 29/0092; F04C 28/08; F04C 28/24; F04C 25/02; F04C 2270/051;
(Continued)

(56) References Cited

U.S. PATENT DOCUMENTS 3,853,520 A * 12/1974 Rau ..... C03B 5/0336 65/32.5
4,613,111 A * 9/1986 Paquet ..... F16K 31/1266 251/30.01
(Continued)

FOREIGN PATENT DOCUMENTS

CN 101517389 A 8/2009
CN 104246230 A 12/2014
(Continued)

OTHER PUBLICATIONS

International Search Report (ISR) dated May 3, 2016, for PCT/BE2016/000005.
(Continued)

*Primary Examiner* — Essama Omgba
*Assistant Examiner* — Christopher J Brunjes
(74) *Attorney, Agent, or Firm* — Bacon & Thomas, PLLC

(57) ABSTRACT

A method for regulating the temperature at an outlet channel of a compressor or a vacuum element, including providing a pressure regulating valve on a influence channel, the influence channel being in direct fluid communication with the compressor or vacuum element, the valve regulating the pressure within the compressor or vacuum element by adjusting the volume of fluid flowing between a process channel and the compressor or vacuum element relative to
(Continued)

the difference between the pressure value within the compressor or vacuum element and a set pressure value, and includes starting the compressor or vacuum element and starting a pre-purge cycle by connecting the inlet channel to a supply of a purge gas for a preselected time interval; connecting the influence channel to a process channel; and disconnecting the inlet channel from the process channel, for maintaining a set temperature within the vacuum element for a selected time interval.

21 Claims, 4 Drawing Sheets

(51) Int. Cl.
*F04C 28/08* (2006.01)
*F04C 25/02* (2006.01)

(52) U.S. Cl.
CPC ..... *F04C 28/24* (2013.01); *F04C 2270/051* (2013.01); *F04C 2270/19* (2013.01); *F04C 2270/195* (2013.01); *F04C 2270/44* (2013.01)

(58) Field of Classification Search
CPC ..... F04C 2270/195; F04C 2270/44; F04C 2270/19; F04C 14/08; F04D 27/004; F04D 29/701; G05D 16/0638; G05D 16/0658; G05D 16/0666; Y10T 137/7835
USPC ..... 417/228
See application file for complete search history.

(56) References Cited

U.S. PATENT DOCUMENTS

| | | | | |
|---|---|---|---|---|
| 4,699,570 | A | 10/1987 | Bohn | |
| 5,614,247 | A | 3/1997 | Barbee et al. | |
| 7,794,523 | B2 * | 9/2010 | Whitlock | B01D 53/40 423/210 |
| 2006/0289295 | A1 | 12/2006 | Jardine | |
| 2007/0135779 | A1 * | 6/2007 | Lalomia | A61M 1/0005 604/319 |
| 2010/0116061 | A1 | 5/2010 | Caps | |
| 2012/0204965 | A1 * | 8/2012 | Loldj | F17D 3/00 137/14 |
| 2015/0010409 | A1 * | 1/2015 | Burggraf | F04D 19/042 417/49 |
| 2015/0086387 | A1 | 3/2015 | Tattersall | |
| 2016/0185538 | A1 * | 6/2016 | Zinski | B65G 53/66 406/117 |

FOREIGN PATENT DOCUMENTS

| | | | |
|---|---|---|---|
| EP | 0338764 | A2 | 10/1989 |
| GB | 2500610 | A | 10/2013 |
| JP | 2001093895 | A | 4/2001 |
| WO | 2004/038222 | A1 | 5/2004 |

OTHER PUBLICATIONS

Chinese Office Action in related Chinese Application No. 2016800057859, dated Aug. 22, 2018.

* cited by examiner

METHOD FOR CONTROLLING A GAS SUPPLY TO A VACUUM PUMP

This invention relates to a method for controlling the temperature at the outlet channel of a vacuum element, the method comprising the step of providing a pressure regulating valve on an inlet channel in direct fluid communication with a vacuum element and adjusting the volume of fluid flowing between the inlet channel and the vacuum element relative to the difference between the pressure value within the vacuum element and a set pressure value.

BACKGROUND OF THE INVENTION

The various types of applications in which vacuum pumps are used today raise a series of concerns regarding the durability and maintenance processes. No matter if the vacuum pumps are connected to a food production line, different machinery or components production line, or within a chemical plant, a significant problem which cannot be avoided is that the environment in which they work generates contaminants such as gaseous vapors or different liquids. It is known that such contaminants have a high corrosive effect over the component elements of the vacuum pumps and, if kept within the system over multiple working cycles they cause significant damages to parts such as the rotors, the casing or the piping structure.

Another significant risk when having contaminants present in the vacuum pump is that they reduce the quality of the sealing oil and even dissolve it, affecting the efficiency of the pump element.

Known systems like the one introduced by Edwards LTD in GB 2,500,610 supply an inert gas, called purge gas, when the system senses that a harsh process gas is exhausted from a process chamber which is evacuated by a vacuum pump. The volume of purge gas can be reduced or minimized when the system senses that a relatively inert gas is passing through the pump, or when the pump enters an idle mode of operation.

Such a system maintains a purge gas flowing therethrough until the level of contaminants at the outlet of the pump is relatively small, which means that some contaminants might remain within the system. This might become a drawback when the vacuum pump is connected to a process channel generating highly corrosive contaminants.

A further drawback of such system is the fact that the volume of purge gas is applied during operation of the vacuum pump, which will not only modify the pressure value at the inlet channel of the vacuum pump and therefore on the process line, but it could also cause the pump to work at a higher capacity for an extensive time interval.

Another limitation of such system is that it does not eliminate water vapors entering in the system. It is known that water vapors can have a damaging corrosive effect.

Taking the above into consideration, it is an object of the present invention to provide a vacuum pump that increases the efficiency of the vacuum element and reduces the risk of damages due to corrosive vapors of different gases or different liquids entering therein.

Another object of the present invention is to eliminate condensate from the vacuum pump and to keep the sealing oil in required quality parameters. Furthermore, the present invention significantly reduces the risk of condensate to appear within the vacuum element during operation.

SUMMARY OF THE INVENTION

The present invention provides a method and a system that decreases the time interval in which a vacuum pump is brought within working parameters and increases the efficiency of the overall system.

The present invention solves at least one of the above identified problems by providing a method for regulating the temperature at an outlet channel of a vacuum element, the method comprising the step of providing a pressure regulating valve on an inlet channel, said inlet channel being in direct fluid communication with the vacuum element, said valve regulating the pressure within the vacuum element by adjusting the volume of fluid flowing between a process channel and the vacuum element relative to the difference between the pressure value within said vacuum element and a set pressure value, wherein the method further comprises the steps of:

- starting the vacuum element and starting a pre-purge cycle by connecting the inlet channel of the vacuum element to a supply of a purge gas for a preselected time interval;
- subsequently connecting the inlet channel to a process channel; and
- disconnecting the inlet channel from the process channel and starting a post-purge cycle in which a flow of a gas is regulated at the inlet channel, for maintaining a set temperature within the vacuum element for a selected time interval.

One of the advantages of the method according to the present invention consists in that, by applying a pre-purge cycle, the vacuum pump is cleaned of contaminants such as water vapors or dissolved gasses before being connected to the process channel. Accordingly the risk of damages due to the corrosive effects of such contaminants is considerably reduced.

Because during the pre-purge cycle the vacuum element is not connected to the process channel, heat is generated due to the compression of gas and the friction generated between the at least one rotor, the sealing oil found on said at least one rotor and the casing of the vacuum element, bringing the sealing oil to a relatively high temperature such that, even if condensate or gasses enter within the vacuum pump, the sealing oil will not be dissolved or damaged and the high efficiency and reliability of the vacuum pump is maintained.

Because the sealing oil is brought to a relatively high temperature, the vacuum pump is being prepared for potential harmful contaminants that could enter during operation.

Because the method follows such a succession of steps, the vacuum pump is not only cleaned from potential contaminants and prepared for operation but it is also maintained in operating parameters for a selected time interval after the inlet channel is disconnected from the process channel.

Preferably, the method further comprises the step of adjusting the speed of the vacuum element during the post-purge cycle such that the temperature measured at the outlet channel is maintained between a pre-determined maximum and minimum value.

By keeping the temperature measured at the outlet channel of the vacuum element within a selected interval, the risk of having condensate formation within the vacuum pump is further decreased. Accordingly, by adjusting the selected temperature interval depending on the chemical composition of the fluid passing through the vacuum pump, it is assured that the vapors are kept in a gaseous state.

At the same time, the vacuum pump is brought to a nominal working speed and temperature before being connected to the process channel, improving the efficiency of the vacuum pump. As soon as the vacuum pump is connected to the process channel, it will start to work at a high yield, eliminating any delays associated with system initializing.

The present invention is further directed to a controller for controlling the supply of a purge gas at an inlet channel of a vacuum element, the controller comprising:

- a speed regulator for measuring and adjusting the rotational speed of at least one rotor of the vacuum element;
- a pressure regulating valve configured to be mounted on an inlet channel in direct fluid communication with the vacuum element, said valve regulating the pressure within the vacuum element by adjusting the volume of fluid flowing between a process channel and the vacuum element relative to the pressure difference between the pressure value within said vacuum element and a set pressure value;

whereby the controller further comprises:

- means for connecting the inlet channel to a supply of a purge gas for a predetermined time interval after the vacuum element is started;
- means for connecting the process channel to a inlet channel of the vacuum element; and
- means for connecting the inlet channel to a supply of a purge gas after the inlet channel is disconnected from the process channel and adjusting the speed of the vacuum element for a predetermined time-interval.

Preferably, the controller is configured to control the start/stop function of a cooling system relative to the temperature measured at the outlet channel.

The present invention is further directed to a vacuum pump comprising:

- a vacuum element having an inlet channel and an outlet channel for a fluid flow;
- a temperature sensor configured to be mounted on an outlet channel of the vacuum element;
- a pressure regulating valve provided on a inlet channel, said inlet channel being in direct fluid communication with the vacuum element, said valve being configured to regulate the pressure within the vacuum element by adjusting the volume of fluid flowing between a process channel and the vacuum element relative to the difference between the pressure value within said vacuum element and a preset pressure value;

whereby the vacuum pump according to the present invention further comprises a controller as described above, configured to receive data from said temperature sensor through a data channel and to adjust the speed of the vacuum element after the inlet channel is disconnected from the process channel, such that the temperature measured at the outlet channel is maintained between a pre-determined maximum and a minimum value.

By selecting a time interval in which a pre-purge cycle is maintained, the vacuum pump is provided with enough time for a complete preparation before the start of the process: the vacuum pump is not only cleaned from potential harmful contaminants from a previous operation, but the time interval will be sufficient for heating the sealing oil of the at least one rotor of the vacuum element, eliminating the risk of condensate to appear within the vacuum pump during operation.

The vacuum pump according to the present invention preferably further comprises a solenoid valve for a gas ballast pump, the solenoid valve being mounted on a channel in direct fluid communication with the vacuum element.

For increasing the fluid flow and the efficiency of the purge cycle, the solenoid valve can be brought in an open state during said purge cycle, eliminating contaminants much faster. Because the fluid flow increases, the power consumption also increases, which helps in decreasing the time interval in which the sealing oil is being brought to a high temperature.

Such a behavior allows the vacuum pump according to the present invention to be reliable, since the time intervals in which the vacuum pump is not used on a production line are reduced. Therefore not only the quality of the vacuum process is kept at very high standards but also the rapidity and quality of the end product or process such vacuum pump is used for.

The present invention is also directed to the use of a controller as previously described, in a vacuum pump, for maintaining the temperature at the outlet channel of the vacuum element between selected values by adjusting the speed of the vacuum element during a post-purge and/or a manual purge cycle.

The present invention is also directed to a vacuum pump being provided with a pressure regulating valve and/or a controller according to the present invention.

BRIEF DESCRIPTION OF THE DRAWINGS

With the intention of better showing the characteristics of the invention, a preferred method and configuration of a system according to the present invention is described hereafter, by way of an example, without any limiting nature, with reference to the accompanying drawings, wherein.

DETAILED DESCRIPTION OF THE INVENTION

Figure 1A:
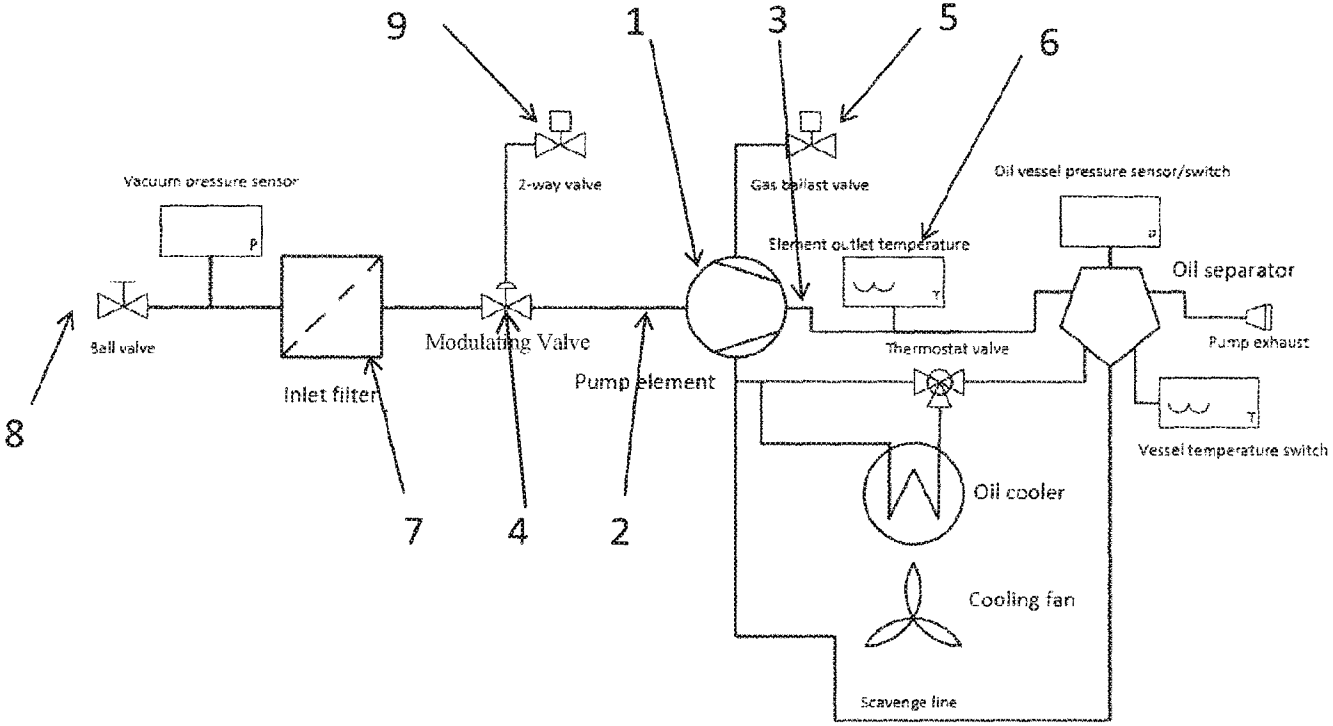
FIG. 1A discloses a vacuum pump according to an embodiment of the present invention.

FIG. 1A shows a schematic representation of a vacuum pump according to the present invention, the vacuum pump comprising: a vacuum element 1 having an inlet channel 2 and an outlet channel 3 for a fluid flow and being provided with a pressure regulating valve 4 configured to be mounted on an inlet channel 2 in direct fluid communication with the vacuum element 1. Said valve 4 being configured to regulate the pressure within the vacuum element 1 by adjusting the volume of fluid flowing between a process channel 8 and the vacuum element 1 relative to the difference between the pressure value within said vacuum element 1 and a set pressure value.

Figure 1B:
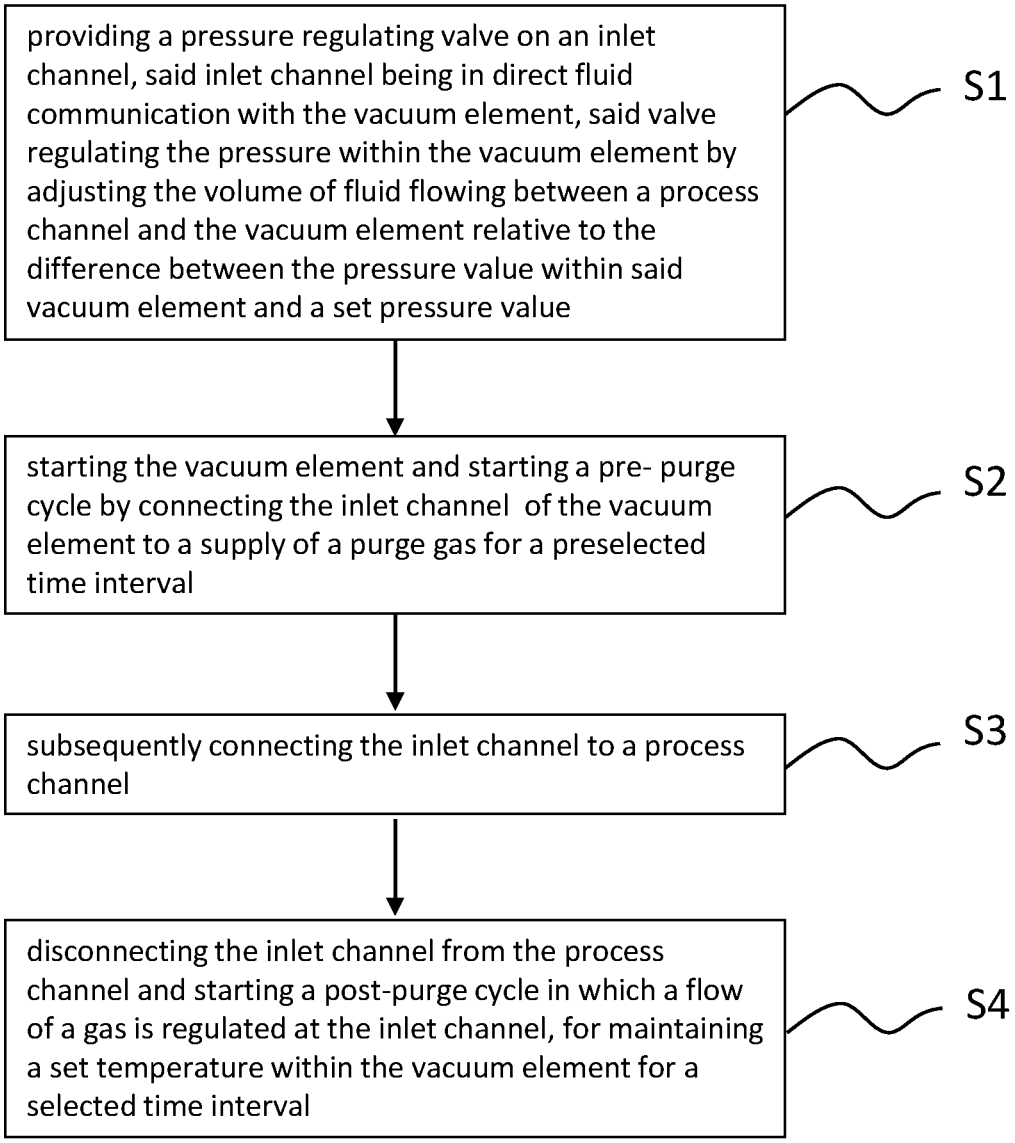
FIG. 1B illustrates the method steps according to an embodiment of the present invention.

As seen in FIG. 1B, the method according to the present invention preferably comprises the step of providing a pressure regulating valve on an inlet channel, said inlet channel being in direct fluid communication with the vacuum element, said valve regulating the pressure within the vacuum element by adjusting the volume of fluid flowing between a process channel and the vacuum element relative to the difference between the pressure value within said vacuum element and a set pressure value, as seen in Step S1, and further comprises starting a pre-purge cycle after the vacuum element 1 is started, by connecting the inlet channel 2 of the vacuum element 1 to a supply of a purge gas for a preselected time interval, as seen in Step S2.

After said preselected time interval, the inlet channel 2 is connected to a process channel 8, as seen in Step S3, and the operation of the vacuum pump is regulated by a pressure controller (not shown). Accordingly, the speed of the motor is adapted according to the requested parameters at the level of the process channel 8, such as:

the fluid flow, temperature and/or pressure.

When the requested parameters are reached, the inlet channel 2 is disconnected from the process channel 8 and the vacuum element 1 is preferably connected to a post-purge cycle, during which a flow of a gas is regulated at the inlet channel 2, for maintaining a set temperature within the vacuum element 1 for a selected time interval, as seen in Step S4.

When the inlet channel 2 is disconnected from the process channel 8, the inlet channel can for example be connected to a supply of fluid (not shown) though for example a regulating valve or a system of valves (not shown). Such a connection can maintain a required temperature within the vacuum element 1 for a selected time interval.

Preferably, when the inlet channel 2 is disconnected from the process channel 8, the pressure regulating valve 4 is brought in a closed state.

In a preferred embodiment according to the present invention, the speed of the vacuum element 1 is adjusted during the post-purge cycle such that the temperature measured at the outlet channel 3 is maintained between a pre-determined maximum and minimum value.

In a preferred embodiment according to the present invention, the vacuum pump further comprises a temperature sensor 6 provided on the outlet channel 3 of the vacuum element 1. The vacuum pump according to the present invention is further connectable to an external process (not shown) through the process channel 8.

Preferably, the speed of the vacuum element 1 is adjusted based on measurements by the temperature sensor 6.

Preferably, the speed of the vacuum element 1 is decreased when the temperature at the outlet channel 3 of the vacuum element 1 rises above the maximum selected temperature, $T_{max}$, and/or the speed of the vacuum element 1 is increased if the temperature at the outlet channel 3 of the vacuum element 1 is lower than the minimum selected temperature, $T_{min}$.

Preferably, the speed of the vacuum element 1 is increased if the temperature measured at the outlet channel 3 is less than 100° C., preferably less than 98° C., more preferably the speed of the vacuum element 1 is increased if the temperature measured at the outlet channel 3 of the vacuum element 1 reaches a value of for example approximately 97.5° C.

In the context of the present invention is to be understood that the temperature at which the speed of the vacuum element 1 is increased, is chosen depending on the environmental conditions. Accordingly, the temperature can also be less than 97.5° C., or less than 95° C., or even less than 60° C.

On the other hand, the speed of the vacuum element 1 is decreased when the temperature measured at the outlet channel 3 rises above 100° C., more preferably higher than 101° C., most preferably, the speed of the vacuum element 1 is decreased if the temperature measured at the outlet channel 3 reaches a value of for example approximately 102.5° C.

In the context of the present invention is to be understood that the temperature at which the speed of the vacuum element 1 is decreased is chosen depending on the environmental conditions. Accordingly, the temperature can also be more than 102.5° C., such as more than 105° C.

Preferably, the inlet channel 2 comprises a duct allowing a flow of fluid between the vacuum element 1 and the process channel 8.

In the context of the present invention, it is to be understood that the vacuum pump can be selected from a group comprising: a single toothed vacuum pump, a double toothed vacuum pump, a claw vacuum pump, a scroll vacuum pump, a turbo vacuum pump, a screw vacuum pump, a rotary vane vacuum pump, etc. Each of the mentioned types of vacuum pumps can be oil free or oil injected.

In the context of the present invention it is to be understood that a vacuum element 1 comprises at least a rotor enclosed within a chamber. For ease of explanation, the rotational speed of the at least one rotor of the vacuum element 1 is hereinafter referred to as the speed of the vacuum element 1.

The method according to the present invention preferably comprises the step of subjecting the vacuum element 1 to a pre-purge cycle after said vacuum element 1 is started, by connecting the inlet channel 2 to a flow of a purge gas and keeping the flow active for a predetermined time interval.

In this way, the contaminants presumably present within the piping system or within the vacuum element 1 are eliminated.

Before the vacuum element 1 is started, the sealing oil present between the rotors and the chamber in which they are held is in a relatively high viscous state. When the rotors start to rotate, friction is occurring between the rotors, the sealing oil and the chamber, generating heat which helps the sealing oil to reach a high temperature and to become less viscous. Furthermore, due to the compression of gas even more heat is generated.

After the predetermined time interval, the vacuum element is brought to a nominal working temperature and pressure, it is cleaned of contaminants and the sealing oil is at a relatively high temperature. Accordingly, during the pre-purge cycle, the vacuum element is being prepared to be connected to the process channel 8.

In a preferred embodiment according to the present invention, when the vacuum element 1 is subjected to a pre-purge cycle, the system will function at a relatively high speed for a predetermined time interval in order to achieve a preset temperature.

Said predetermined time interval can be selected for example between 1 and 20 minutes, depending on the requirements of each process.

Said preset temperature can be selected between 60-100° C., like for example, the preset temperature can be 80° C.

In a preferred embodiment according to the present invention, the method further comprises the step of reducing the speed of the vacuum element 1 to a predetermined working speed, before connecting the inlet channel 2 to the process channel 8. Because, during the pre-purge cycle, the vacuum element 1 is working at high speed, and because in most of the cases, immediately before connecting the vacuum element 1 to the process channel 8, the pressure value within the process channel 8 is higher than the pressure value within the vacuum element 1, this step ensures that the motor driving the vacuum element 1 is not overloaded or does not experience high oscillations that would affect its behavior and reduce its lifespan.

After the vacuum element 1 is connected to the process channel 8, the vacuum element 1 enters in a so called modulating state and the operation of the vacuum pump is regulated by the pressure controller. In such a state, the temperature at the level of the vacuum element 1 is maintained between a minimum and a maximum value by an on/off cooling system (not shown). Accordingly, if the temperature of the vacuum element 1 increases above a maximum value, the cooling system is activated and will start influencing the temperature of the vacuum element 1. When the temperature of the vacuum element 1 reaches a minimum value, the cooling system is stopped.

In a preferred embodiment according to the present invention, once a desired pressure value at the inlet channel 2 is reached, the pressure regulating valve 4 is brought into a closed state and no fluid will flow from the external process into the vacuum element 1. At this stage, the inlet channel 2 is disconnected from the process channel 8 and preferably connected to a flow of purge gas, called the post-purge cycle.

During the post-purge cycle, the data coming from a temperature sensor 6 mounted on the outlet channel 3 is used to adjust the speed of the rotor(s) such that the temperature at the outlet channel 3 is maintained between a minimum and a maximum value and accordingly, nominal functional parameters are maintained.

Accordingly, contaminants that may have entered within the system during operation such as water or different gasses, are eliminated.

By maintaining the set temperature within the vacuum element 1 for a selected time interval, the vacuum element 1 is kept in nominal working parameters such that it can be immediately connected to the external process, if required. As a result thereof, the reliability and responsiveness of the system are increased.

Preferably, during the post-purge cycle, the speed and temperature within the vacuum element 1 are maintained within nominal parameters such that, if the pressure value rises on the process channel 8 and the vacuum element 1 is needed to be connected to the external process, the vacuum element 1 will immediately influence the pressure on the process channel 8 with a high yield, eliminating unwanted waiting time intervals and increasing the efficiency of the vacuum element 1.

Preferably, during the post-purge cycle the temperature within the vacuum element 1 is maintained between 60-100° C., more preferably said temperature is maintained at approximately 100° C. Accordingly, when the system measures a temperature of 105° C., more preferably of approximately 103° C. at the outlet channel 3 of the vacuum element 1, it will reduce the speed of the vacuum element 1.

On the other hand, when the system measures a temperature of 95° C., more preferably of approximately 98° C. at the outlet channel 3 of the vacuum element 1, it will increase the speed of the vacuum element 1.

Because the system maintains such temperatures at the outlet channel 3 of the vacuum element 1 for a predetermined time interval, the system according to the present invention applies a energy efficient method for removing water vapors that might have entered within the vacuum element 1.

In a preferred embodiment according to the present invention the pressure regulating valve 4 maintains the pressure level of the inlet channel 2 at a relatively constant value of approximately 400 mbar when the pressure value within the process channel 8 is higher than 400 mbar.

Preferably, the pressure regulating valve 4 is in a closed state when the pressure value within the process channel 8 is higher than 400 mbar.

When the pressure value within the process channel 8 reaches the value of 400 mbar or lower, the pressure regulating valve 4 is preferably opened, and the pressure value within the process channel 8 will have approximately the same value as within the vacuum element 1.

In the context of the present invention it is to be understood that the value of 400 mbar can be modified depending on the process the vacuum pump is connected to. For example, such a value can be any selected value comprised within the interval, and not limiting to: 200-800 mbar.

Preferably, once the pressure regulating valve 4 is brought into an open state, a variable frequency drive unit (not shown), part of the motor driving the vacuum pump, will adjust the pressure value within the vacuum element 1 and the process channel 8 accordingly.

For an increased efficiency, the method further comprises the step of maintaining the pressure regulating valve 4 in a closed state during the pre-purge cycle and/or the post-purge cycles such that no fluid will leak out of the vacuum element 1 to the process channel 8.

Figure 2:
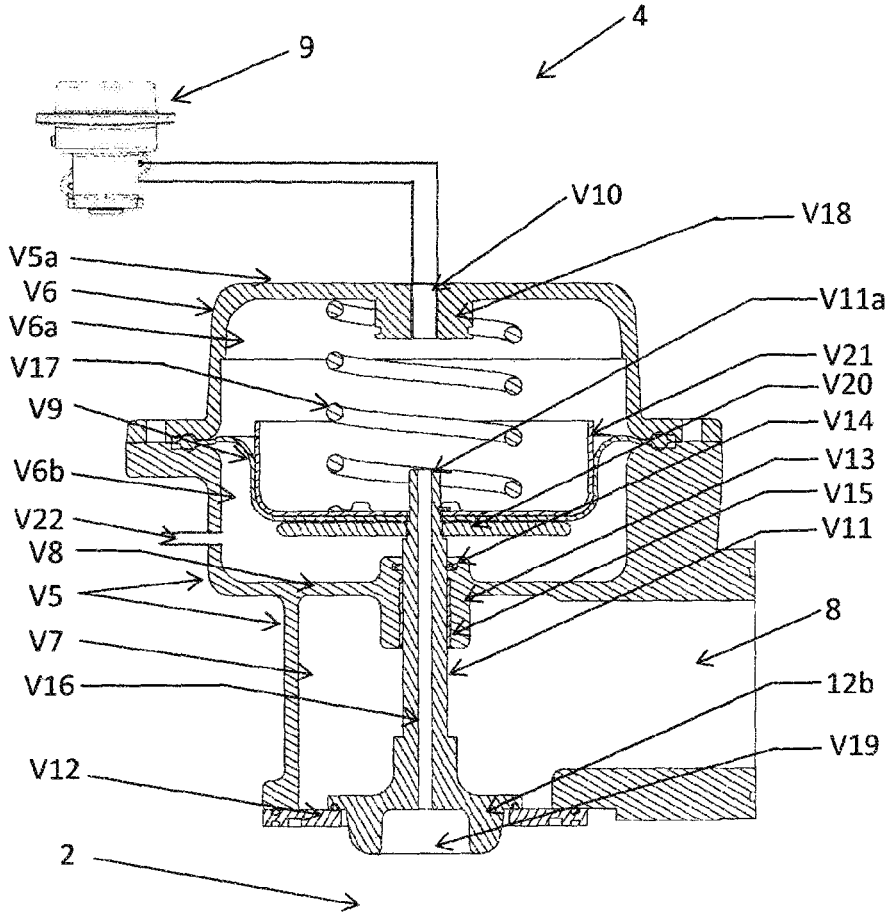
FIG. 2 discloses a pressure regulating valve according to an embodiment of the present invention.
Figure 3:
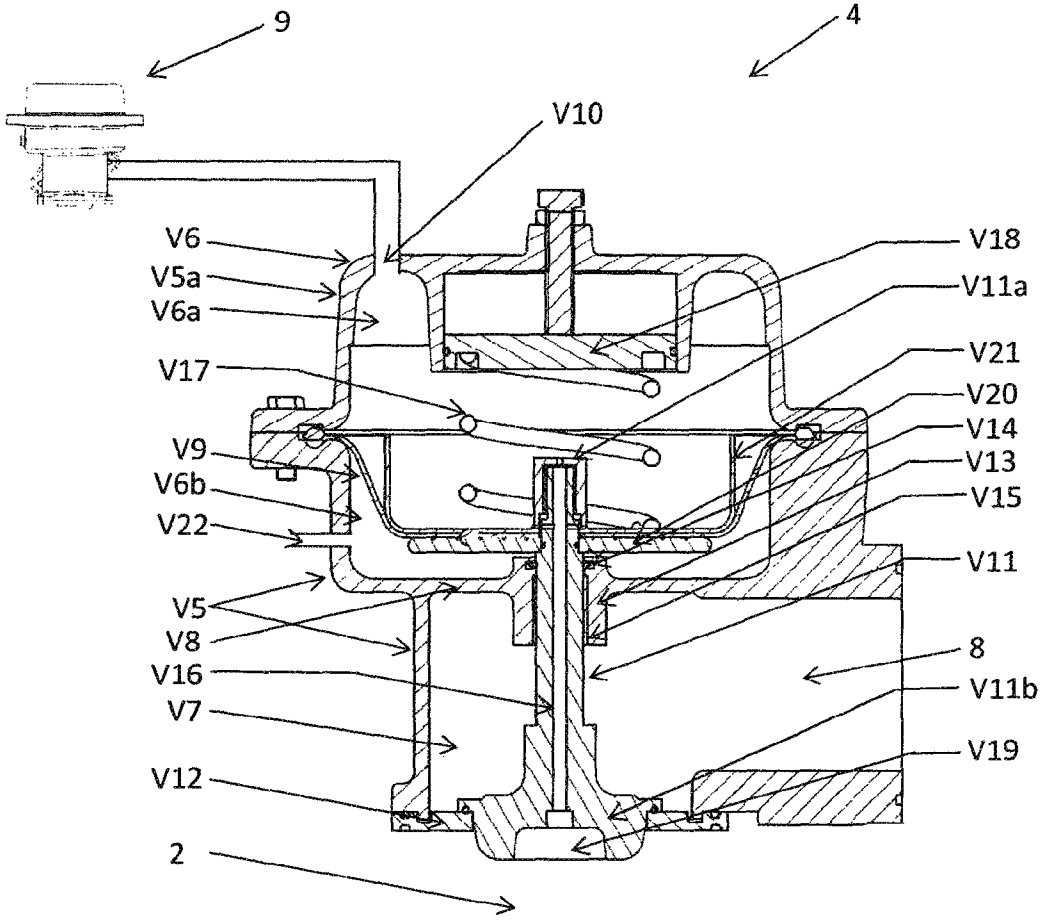
FIG. 3 discloses a pressure regulating valve according to another embodiment of the present invention.

Preferably, the pressure regulating valve 4 (FIG. 2 or FIG. 3) is comprising a housing V5 delimiting a first chamber V6 and a second chamber V7 separated by a wall V8. The first chamber V6 comprises a movable element V9 that defines a first cavity V6*a* and a second cavity V6*b* fluidly sealed from each other. The first cavity V6*a* comprising an inlet channel V10 connected to a first supply of a fluid, and means for exerting a force on the movable element V9.

Preferably, said wall V8 acts as a separation between the second chamber V7 and the second cavity V6*b* of the first chamber V6.

The housing V5 can for example comprise a lid V5*a*.

In this case but not necessarily, the inlet channel V10 is provided centrally on the lid V5*a* opposite from the second cavity V6*b*.

The second chamber V7 is in direct communication with a process channel 8 of a supply of a fluid and further comprises therein a valve body V11 having a distal end V11*a* extending into the first cavity V6*a* of the first chamber V6 and a proximal end V11*b*, said valve body V11 being movable between an initial closed state in which the proximal end V11*b* is pushed against a sealing flange V12 and a second, opened state, in which a fluid flows between the process channel 8 and the inlet channel 2 of the vacuum element 1.

In the context of the present invention it is to be understood that the housing V5 can be made by one integral part or several separate parts.

The valve body V11 is slidably mounted in the wall V8 in such a way as to prevent a fluid flow between the second chamber V7 and the second cavity V6*b* of the first chamber V6.

Preferably, the sealing flange V11 is forming an opening towards the inlet channel 2 of the vacuum element 1.

In a preferred embodiment according to the present invention the valve body V11 is mounted within a guide V13, in this case in the shape of a pipe-shaped element, comprising a seal V14 and a bushing V15 mounted at the level of the guide V13 to eliminate the risk of encountering any residual fluid flow between the second cavity V6*b* of the first chamber V6 and the second chamber V7.

Preferably the valve body V11 comprises a fluid channel V16 extending through said valve body V11 allowing a fluid flow between the first cavity V6*a* and the inlet channel 2 of the vacuum element 1. Accordingly, the pressure within the first cavity V6*a* will have the same value as the pressure value of the fluid at the inlet channel 2 of the vacuum element 1.

The movable element V9 can for example be in the shape of a membrane, or a piston, or a metal plate.

Preferably, said means for exerting a force on the movable element V9 can be in the shape of: a spring, a piston or a metal plate such as a steel plate for which exerting a force on the movable element V9 is intrinsic in the material properties. The force generated on the movable element V9 can either be compressive or tensile.

Preferably, the means for exerting a force on the movable element V9 comprise a spring V17 positioned in the first cavity V6*a* and pushing on said movable element V9.

The spring V17 can be, for example, positioned centrally within said cavity V6*a* of the first chamber V6 and pushing on a centrally positioned surface on the movable element V9.

Preferably, the housing V5 comprises a collar V18 around the inlet channel V10 for positioning said spring V17 and keeping it in a stable central position. The inlet channel V10 can be positioned concentrically with respect to said collar V18.

In another embodiment according to the present invention, the inlet channel V10 can be positioned on the lateral sides of the lid V5*a*.

Preferably, the spring V17 is generating in an initial closed state a force $F_1$ of less than 3000N (Newton), more preferably the spring V17 is generating a force $F_1$ of less than 2000N, even more preferably, the spring V17 is generating a force $F_1$ of 1000N or less.

In a preferred embodiment, the spring V17 is generating in an initial closed state a force Fl in the range from 500-2000N.

Preferably, the proximal end V11*b* pushing against the sealing flange V12 is, in this example, in the shape of a frustum of a cone with rounded edges having the base with the biggest diameter at the end facing the second chamber V7 and the base with the smallest diameter at the end facing inlet channel 2 of the vacuum element 1.

Preferably, the proximal end V11*b* has a hollow cavity V19 at the end facing the inlet channel 2 of the vacuum element 1.

The inlet valve 4 preferably comprises two guiding elements V20 and V21 for guiding the movable element V9: the first guiding element V20 being positioned in the second cavity V6*b* of the first chamber V6 between the movable element V9 and the wall V8 separating the first chamber V6 and the second chamber V7, and the second guiding element V21 being positioned in the first cavity V6*a* of the first chamber V6, between the movable element V9 and the spring V17.

The movable element V9 can be in the shape of a piston, or a metal plate. Preferably, the movable element V9 is a membrane fixed in the housing V5 of the first chamber V6.

In another embodiment according to the present invention the first guiding element V20 is in the shape of a cylindrical block with a hollow carving created on the side facing the wall V8 for receiving the guide V13 therein.

In another embodiment according to the present invention the first guiding element V20 is in the shape of a disk having a hole therein for receiving the valve body V11.

The second guiding element V21 can be in the shape of a disk against which, on one side the spring V17 is resting, and has a hole therein for receiving the valve body V11.

Preferably, the guiding element V21 comprises a circumferential rim extending towards the lid V5*a*.

Preferably, the second cavity V6*b* of the first chamber V6 further comprises an inlet channel V22 fluidly connecting said second cavity V6*b* to a supply of a first fluid at pressure $P_1$.

For ease of design, the first fluid is preferably air and $P_1$ is preferably the atmospheric pressure.

For controlling the volume of fluid flowing though the inlet channel V10 of the first cavity V6*a* of the first chamber V6 and through the valve body V11 towards the inlet channel 2 of the vacuum element 1, the inlet channel V10 of the first cavity V6*a* of the first chamber V6 further comprises means for sealing said first cavity V6*a* from the fluid flow at pressure $P_1$.

Preferably but not limiting to, said means for sealing said first cavity V6*a* from the fluid flow is a valve 9.

In an embodiment according to the present invention, when the vacuum element 1 is subjected to a purge cycle, the pressure regulating valve 4 is maintained in a closed state. Once the vacuum element 1 is connected to an external process, the pressure regulating valve 4 will control the volume of fluid flowing between the process channel 8 and the vacuum element 1 as will be further explained.

If the pressure at the inlet channel 2 of the vacuum element 1, $P_{element}$, is lower than a minimum set value, the valve body V11 slidably moves against the force generated by the spring V17 in the direction of the first chamber V6, lifting the proximal end V11*b* of the valve body V11 from the sealing flange V12) and allowing a fluid flow between the process channel 8 and the inlet channel 2 of the vacuum element 1.

When the pressure value at the inlet channel 2 of the vacuum element 1 reaches a value sufficiently high such that the pressure difference between the first cavity V6*a* and the second cavity V6*b* of the first chamber V6 is sufficiently low to allow the proximal end V11*b* of the valve body V11 to move towards the sealing flange V12 and reduce the flow of fluid. If the pressure within the inlet channel 2 of the vacuum element 1 is still too high, the proximal end V11*b* of the valve body V11 is moved until it is pushed against said sealing flange V12, completely stopping the fluid flow between the process channel 8 and the inlet channel 2 of the vacuum element 1.

In a preferred embodiment according to the present invention, the pressure value at which the proximal end V11*b* of the valve body V11 is lifted from the sealing flange V12 and/or is pushed against the sealing flange V12 is adjusted depending on the application at which the vacuum pump is connected to.

Preferably, when $P_{element}$ is higher than a minimum set value, the proximal end V11*b* is pressing against the sealing flange V12 and a flow of fluid flows through the fluid channel V16. When $P_{element}$ is equal to or lower than the minimum set value, the valve 9 closes and no fluid flows through the fluid channel V16, the pressure regulating valve 4 entering in a modulating state. The pressure $P_{element}$ and the pressure value within the process channel 8 is influenced in such a state by the variable speed drive unit or inverter, part of the driving means of the vacuum pump.

Preferably, said driving means can be a combustion engine or an electrical motor, a turbine such as a water turbine or a steam turbine, or the like.

The driving means can be directly driven or can be driven by an intermediate transmission system like a coupling or a gear box.

Because the vacuum pump according to the present invention uses a pressure regulating valve 4 as described above, a permanent flow of fluid throughout the valve body V8 can be maintained during the purge cycles, increasing the volume of fluid flowing throughout the vacuum element 1 and increasing the reliability of such purge cycles. Accordingly the time intervals allocated for performing the purge cycles can be reduced.

Preferably, but not necessarily, the pressure regulating valve 4 is of a type as described in patent application BE 2015/5072, which is herein incorporated by reference in its entirety.

In the context of the present invention it is to be understood that other types of valves, having a different structure can be used as well.

After the vacuum element 1 is connected to the external process, the pressure regulating valve 4 will maintain the pressure at a relatively constant value and the controller according to the present invention adjusts the speed of the at least one rotor within the vacuum element 1 such that the temperature measured at the outlet channel 3 of the vacuum element 1 is maintained between a minimum and a maximum.

Accordingly, if the temperature within the vacuum element 1 is maintained at a sufficiently high value, the risk of having condensate formed within the vacuum element 1 is eliminated.

In a preferred embodiment according to the present invention, when the vacuum element 1 is connected to the external process, the valve 9 is brought in a closed state, such that the vacuum element 1 influences the pressure at the level of the external process with a maximum yield.

If, after the predetermined time interval set for the pre-purge cycle, the temperature of the sealing oil does not reach the value assuring that no condensate forms within the vacuum element 1 during operation, the system could generate an alert signal for informing the user about such a risk.

Preferably, the method according to the present invention further comprises the step of providing a solenoid valve 5 for gas ballast, the solenoid valve 5 being mounted on a channel in direct fluid communication with the vacuum element 1.

Preferably, the solenoid valve is controlling the flow of a gas used for removing gaseous impurities from the vacuum pump. Said gas can be selected from a group comprising: ambient air, nitrogen, helium, xenon, other gases or any combination thereof.

Preferably, said solenoid valve 5 is opened for the duration of a purge cycle to assure a more efficient discharge of the contaminants.

In a preferred embodiment according to the present invention, the method further comprises the step of manually starting a purge cycle.

During the manual purge cycle, the pressure regulating valve 4 is preferably brought into a closed state.

The step of manually starting a purge cycle can be followed at any time a user of a vacuum pump according to the present invention desires. Preferably, once the vacuum element 1 does not need to be connected to the process channel 8 for a minimum amount of time, the vacuum element 1 can be connected to a manually started purge cycle and cleaned of any fluids, bringing the vacuum pump into a so called dry state.

Preferably, the duration of a purge cycle, either pre-purge, post-purge or a manually started purge cycle can be selected by the user depending on the process the pump is connected to.

Preferably, but not limited to, the duration of the manual purge cycle and the temperature maintained at the outlet channel 3 of the vacuum element 1 are chosen in the same manner as the ones for a post-purge cycle. Moreover, the speed of the vacuum element 1 is regulated in the same manner as during a post-purge cycle.

Preferably, during a pre-purge cycle, the system will function at maximum speed until a desired temperature is reached, and during a post-purge cycle the system preferably maintains a set temperature within the vacuum element 1 by varying the speed.

The present invention is further directed to a controller for controlling the supply of a purge gas at an inlet channel 2 of a vacuum element 1.

Preferably, the controller comprises a speed regulator for measuring and adjusting the rotational speed of at least one rotor of the vacuum element 1 and a pressure regulating valve 4 configured to be mounted on the inlet channel 2 in direct fluid communication with the vacuum element 1, said valve 4 regulating the pressure within the vacuum element 1 by adjusting the volume of fluid flowing between a process channel 8 and the vacuum element 1 relative to the pressure difference between the pressure value within said vacuum element 1 and a set pressure value. The controller according to the present invention further comprises means for connecting the inlet channel 2 to a supply of a purge gas for a predetermined time interval after the vacuum element 1 is started, means for connecting the process channel 8 to the inlet channel 2 of the vacuum element 1, and means for connecting the inlet channel 2 to a supply of a purge gas after the inlet channel 2 is disconnected from the process channel 8 and adjusting the speed of the vacuum element 1 for a predetermined time-interval.

In the context of the present invention it is to be understood that the controller is an electronic module capable of modifying a state of at least one component of the vacuum pump and preferably having a user interface. The user interface can comprise: at least a command button, a switch, a touch screen, or a combination thereof.

In the context of the present invention it is to be understood that when it is specified that the controller (not shown) influences the state of a component in a particular way such as for example and not limiting to: increases or decreases the speed of at least one rotor of the vacuum element 1, or brings the solenoid valve 5 in an open position, or connects the inlet channel 2 to a flow of purge gas, the controller then generates a signal, for example an electrical signal, that changes the state of said component.

Preferably, said means for connecting the inlet channel 2 to a supply of a purge gas comprises means for generating an electrical signal which is opening the channel between the supply of a purge gas and the inlet channel 2. The electrical signal can for example open a valve mounted on said channel or can actuate a switch that directs the course of a fluid through said channel, or the like. The same applies when discussing about the means for connecting the process channel 8 to an inlet channel 2 of the vacuum element 1.

Preferably said means of connecting the inlet channel 2 to a supply of a purge gas comprises a valve 9. Preferably, said valve 9 is a solenoid valve further comprising a filter and said purge gas is preferably ambient air.

Preferably, said valve 9 is connected to a supply of a purge gas through a nozzle (not shown).

In a preferred embodiment according to the present invention the nozzle of valve 9 has a diameter much bigger than the nozzle at the level of the distal end V11*a* of the pressure regulating valve 4. Because of this, when the valve 9 is opened, a fluid flow is kept from the valve 9, through the pressure regulating valve 4 and into the inlet channel 2 of the vacuum element 1.

Preferably, the controller according to the present invention further comprises a temperature sensor 6 configured to be mounted on an outlet channel 3 of the vacuum element 1. The temperature sensor 6 being connected to the controller through a data channel and sending measurement data to said controller.

In the context of the present invention it is to be understood that said data channel can be a wired or a wireless data channel.

In the context of the present invention, said means for adjusting the speed of the vacuum element 1 can be for example a signal generated by the controller on a data channel established between the speed regulator and said controller or can be a two state switch or a potentiometer being influenced by a signal generated by said controller.

In another example, said controller can be incorporated within the electronic module of the motor driving the vacuum pump and said means for adjusting the speed of the vacuum element 1 can be an electrical signal sent to the speed regulator.

The speed regulator for measuring and adjusting the rotational speed of at least one rotor of the vacuum element 1 is preferably connected to said controller through a data channel.

The controller can be part of the vacuum pump or can be an external element connected through a data channel with the vacuum pump.

If the controller is not part of the vacuum pump, then the temperature sensor 6 and the speed regulator can either establish a data channel with a central communication element mounted at the level of the vacuum pump, or can establish a data channel directly with the temperature sensor 6 and the speed regulator.

In a preferred embodiment according to the present invention, the controller maintains the temperature measured at the outlet channel 3 within the selected interval during the post-purge or manual purge cycles by decreasing the speed of the vacuum element 1 if the temperature at the outlet channel 3 of the vacuum element is above a maximum selected temperature, $T_{max}$ and/or increasing the speed of the vacuum element 1 if the temperature at the outlet channel 3 of the vacuum element 1 is less than a minimum selected temperature, $T_{min}$.

Preferably, the controller increases the speed of the vacuum element 1 if the temperature measured at the outlet channel 3 is less than 100° C., preferably less than 98° C., more preferably the controller increases the speed of the vacuum element 1 if the temperature measured at the outlet channel 3 of the vacuum element 1 reaches a value of approximately 97.5° C.

On the other hand, the controller decreases the speed of the vacuum element 1 if the temperature measured at the outlet channel 3 is higher than 100° C., more preferably higher than 101° C., most preferably, the controller decreases the speed of the vacuum element 1 if the temperature measured at the outlet channel 3 reaches a value of approximately 102.5° C.

Accordingly, at the above indicated temperature values and considering the atmospheric discharge conditions such as atmospheric pressure, temperature and relative humidity to be the usually encountered values, the water vapors remain in a gaseous state, and condensate cannot form within the vacuum element 1.

The present invention is further directed to a vacuum pump comprising: a vacuum element 1 having an inlet channel 2 and an outlet channel 3 for a fluid flow, a temperature sensor 6 configured to be mounted on an outlet channel 3 of the vacuum element 1 and a pressure regulating valve 4 provided on the inlet channel 2, said inlet channel 2 being in direct fluid communication with the vacuum element 1, said valve 4 being configured to regulate the pressure within the vacuum element 1 by adjusting the volume of fluid flowing between a process channel 8 and the vacuum element 1 relative to the difference between the pressure value within said vacuum element 1 and a preset pressure value. The vacuum pump further preferably comprises a controller as described above, configured to receive data from said temperature sensor 6 through a data channel and to adjust the speed of the vacuum element 1 after the inlet channel 2 is disconnected from the process channel 8, such that the temperature measured at the outlet channel 3 is maintained between a pre-determined maximum and a minimum value.

Preferably, the vacuum pump is further connectable to an external process (not shown), through the process channel 8.

For cleaning the system more efficiently during a purge cycle, the vacuum pump further comprises a solenoid valve 5 for gas ballast, the solenoid valve 5 being mounted on a channel in direct fluid communication with the vacuum element 1.

Preferably, the controller increases the speed of the vacuum element 1 if the temperature at the outlet channel 3 of the vacuum element 1 rises above a maximum selected temperature, $T_{max}$ and/or decreases the speed of the vacuum element 1 if the temperature at the outlet channel 3 of the vacuum element 1 is less than a minimum selected temperature, $T_{min}$.

Preferably, $T_{min}$ is less than 100° C., more preferably $T_{min}$ is less than 98° C. and most preferably $T_{min}$ is approximately 97.5° C., and/or $T_{max}$ is more than 100° C., more preferably, $T_{max}$ is more than 101° C. and most preferably $T_{max}$ is approximately 102.5° C.

In a preferred embodiment according to the present invention, after the vacuum element 1 is disconnected from the external process, a post-purge cycle starts. Such a cycle not only cleans the vacuum pump but also maintains it at working temperature for a selected time interval. Therefore if the vacuum pump would need to be used within the selected time interval, an immediate connection to the external process will be possible without any risks of having contaminants left within the vacuum pump.

Preferably, during the post-purge cycle the temperature within the vacuum element 1 is maintained between 60-100° C., more preferably said temperature is maintained at approximately 100° C. Accordingly, when the system measures a temperature of 105° C., more preferably of approximately 103° C. at the outlet channel 3 of the vacuum element 1, it will reduce the speed of the vacuum element 1.

On the other hand, when the system measures a temperature of 95° C., more preferably of approximately 98° C. at the outlet channel 3 of the vacuum element 1, it will increase the speed of the vacuum element 1.

If needed, the controller is able to generate a signal for starting a purge cycle for cleaning the vacuum pump.

Preferably, the controller further comprises means for starting a purge cycle manually.

Accordingly, a user can start a purge cycle manually by actuating a button or switch at the level of the controller.

In a preferred embodiment according to the present invention, the vacuum pump also comprises an inlet filter 7, which eliminates the solid impurities coming from the process channel 8.

Preferably, when the vacuum element 1 is connected to a post-purge or a manual purge cycle, the controller increases or decreases the speed of the rotors such that the temperature measured at the outlet channel 3 is maintained within a selected interval. The controller is able to decrease the speed of the rotors until fully stopping the vacuum element 1 and also to increase the speed of said rotors until a maximum allowed value is reached. Furthermore, once the vacuum element 1 is brought in a fully stopped state, the controller is also able to restart it.

the controller controls the action of a cooling system (not shown) for a temperature control of the vacuum element 1. Accordingly, if the temperature of the vacuum element 1 increases rapidly, the controller generates a signal to the cooling system, which will start influencing the temperature of the vacuum element 1.

Preferably a solenoid valve 5 for gas ballast is being provided on a channel in direct fluid communication with the vacuum element 1. Preferably, the controller brings the solenoid valve 5 in an open state for the duration of the purge cycle for increasing the efficiency of the cleaning process.

The present invention is further directed to a use of a controller according to the present invention in a vacuum pump, for maintaining the temperature at the outlet channel 3 of the vacuum element 1 between selected values by adjusting the speed of the vacuum element 1 during a post-purge and/or a manual purge cycle.

The present invention is also directed to a vacuum pump being provided with a pressure regulating valve 4 and a controller according to the present invention.

FIG. 1A comprises other component elements that are not mentioned in the present description. Such elements are included for a good functioning of the vacuum pump and should not be regarded as limiting features.

The present invention is by no means limited to the embodiment described as an example and shown in the drawings, but such a method can be realized in all kinds of variants, without departing from the scope of the invention.

The invention claimed is:

1. A method for regulating a temperature at an outlet channel of a vacuum element, the method comprising the step of:

providing a pressure regulating valve on an inlet channel, said inlet channel being in direct fluid communication with the vacuum element, said pressure regulating valve regulating a pressure within the vacuum element by adjusting a volume of fluid flowing between a process channel and the vacuum element relative to a difference between the pressure value within said vacuum element and a set pressure value;

wherein the method further comprises the steps of:

starting the vacuum element and starting a pre-purge cycle by connecting the inlet channel of the vacuum element to a supply of a purge gas for a preselected time interval;

subsequently connecting the inlet channel to the process channel; and disconnecting the inlet channel from the process channel and starting a post-purge cycle in which a flow of the purge gas is regulated at the inlet channel, for maintaining a set temperature within the vacuum element for a selected time interval.

2. The method according to claim 1, further comprising a step of adjusting a speed of the vacuum element such that the temperature measured at the outlet channel is maintained between a pre-determined maximum and minimum value.

3. The method according to claim 1, wherein a speed of the vacuum element is decreased if the temperature at the outlet channel of the vacuum element is higher than a maximum selected temperature, Tmax, and/or the speed of the vacuum element is increased if the temperature at the outlet channel of the vacuum element is lower than a minimum selected temperature, Tmin.

4. The method according to claim 3, wherein Tmin is less than 100° C.

5. The method according to claim 3, wherein Tmax is more than 100° C.

6. The method according to claim 1, further comprising the step of providing a solenoid valve for a gas ballast, the solenoid valve being mounted on a channel in direct fluid communication with the vacuum element.

7. The method according to claim 6, wherein the solenoid valve is opened for the duration of a purge cycle.

8. The method according to claim 1, further comprising the step of manually starting a purge cycle.

9. A controller for controlling a supply of a purge gas at an inlet channel of a vacuum element, the controller comprising:

a speed regulator for measuring and adjusting a rotational speed of at least one rotor of the vacuum element;

a pressure regulating valve configured to be mounted on the inlet channel in direct fluid communication with the vacuum element, said pressure regulating valve regulating a pressure within the vacuum element by adjusting a volume of fluid flowing between a process channel and the vacuum element relative to a pressure difference between the pressure value within said vacuum element and a set pressure value;

wherein the controller further comprises:

a means for connecting the inlet channel to the supply of the purge gas for a preselected time interval after the vacuum element is started and for connecting the inlet channel to the supply of the purge gas after the inlet channel is disconnected from the process channel; a means for connecting the process channel to the inlet channel of the vacuum element;

wherein the controller is configured to adjust the speed of the vacuum element for a predetermined time-interval and the controller is configured in in a way such that during a pre-purge cycle, the means for connecting the inlet channel to the supply of the purge gas is able to be used to connect the inlet channel of the vacuum element to the supply of the purge gas for the preselected time interval after the vacuum element is started;

subsequently the means for connecting the process channel to the inlet channel of the vacuum element is able to be used to connect the inlet channel to the process channel; and the means for connecting the process channel to the inlet channel is able to be disconnected and the means for connecting the inlet channel to the supply of the purge gas after the inlet channel is disconnected is able to be used during a post-purge cycle in which a flow of the purge gas is regulated at the inlet channel, for maintaining a set temperature within the vacuum element for the predetermined time interval.

10. The controller according to claim 9, wherein said means for connecting the inlet channel to the supply of the purge gas comprises a second valve.

11. The controller according to claim 9 further comprising a temperature sensor configured to be mounted on an outlet channel of the vacuum element.

12. A vacuum pump comprising the controller according to claim 9, said vacuum pump further comprising:

the vacuum element having the inlet channel and an outlet channel for a fluid flow;

a temperature sensor configured to be mounted on the outlet channel of the vacuum element;

the pressure regulating valve provided on the inlet channel, said inlet channel being in direct fluid communication with the vacuum element;

wherein the controller is configured to receive data from said temperature sensor through a data channel and to adjust the rotational speed of the vacuum element after the inlet channel is disconnected from the process channel, such that the temperature measured at the outlet channel is maintained between a predetermined maximum and a minimum value.

13. The vacuum pump according to claim 12 further comprising a solenoid valve for a gas ballast, the solenoid valve being mounted on a channel in direct fluid communication with the vacuum element.

14. The vacuum pump according to claim 12, wherein the controller increases the speed of the vacuum element if the temperature at the outlet channel of the vacuum element rises above a maximum selected temperature, Tmax and/or decreases the speed of the vacuum element if the temperature at the outlet channel of the vacuum element is less than a minimum selected temperature, Tmin.

15. The vacuum pump according to claim 14, wherein Tmin is less than 100° C.

16. The vacuum pump according to claim 14, wherein Tmax is more than 100° C.

17. The vacuum pump according to claim 12, wherein the controller can generate a signal for starting a purge cycle for cleaning the vacuum pump.

18. The vacuum pump according to claim 12, wherein the controller element further comprises a starter for starting a purge cycle manually.

19. The vacuum pump according to claim 18, wherein said starter for starting the purge cycle manually can be in the shape of a button or switch at the level of the controller.

20. A method of using the controller according to claim 9 in a vacuum pump for maintaining the temperature at an outlet channel of the vacuum element between selected values, comprising adjusting the speed of the vacuum element during the post-purge and/or a manual purge cycle.

21. A vacuum pump comprising the pressure regulating valve and the controller according to claim 9.

* * * * *